US006368129B1

(12) United States Patent
Wang et al.

(10) Patent No.: US 6,368,129 B1
(45) Date of Patent: Apr. 9, 2002

(54) ELECTRICAL CONNECTOR WITH OUTER AND INNER SLEEVES

(75) Inventors: Ta-Wei David Wang; Yu Chen Yu, both of Taoyuan Shien (TW); Bay Shao Ru Su, Bothell, WA (US)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 09/710,485

(22) Filed: Nov. 10, 2000

(30) Foreign Application Priority Data

Dec. 24, 1999 (TW) ..... 088117537

(51) Int. Cl.[7] ..... H01R 13/15
(52) U.S. Cl. ..... 439/260; 439/60; 439/141
(58) Field of Search ..... 439/260, 74, 637

(56) References Cited

U.S. PATENT DOCUMENTS 2,711,523 A * 6/1955 Willis ..... 439/260
3,300,752 A * 1/1967 Benoit et al. ..... 439/260
3,697,929 A * 10/1972 Konewko ..... 439/260
4,448,466 A * 5/1984 Porter ..... 439/260
4,560,221 A * 12/1985 Olson ..... 439/260
5,800,186 A * 9/1998 Ramirez et al. ..... 439/637

* cited by examiner

*Primary Examiner*—Neil Abrams
*Assistant Examiner*—J. F. Duverne

(57) ABSTRACT

The present invention provides a dust-proof electrical connector. This connector includes an outer sleeve and an inner sleeve as a receiving end for connecting a corresponding connector. The inner sleeve contacts a first contact terminal disposed on the corresponding connector. A second contact terminal is pierced through the outer sleeve and inner sleeve, for forcing and contacting the first contact terminal when the inner sleeve is moved to a specific position relative to the outer sleeve.

15 Claims, 6 Drawing Sheets

ELECTRICAL CONNECTOR WITH OUTER AND INNER SLEEVES

BACKGROUND OF THE INVENTION

1. Field of the Invention

The present invention relates to an electrical connector for connecting with a corresponding connector, especially to an electrical connector comprising a slidable inner sleeve and an outer sleeve to connect with a printed circuit board for transferring data into a data bus.

2. Description of the Related Art

The electrical connector is usually used for transmitting the electric signal, which may transfer the data information from different interfaces of peripheral equipment to the object machine. Generally speaking, a first contact terminal serves as a plugging end usually disposed on the corresponding connector or disposed in the front end of an interface card, and a second contact terminal serves as a receiving end usually disposed on one end of an electrical connector or disposed on the object machine for connecting the plugging end of the corresponding connector or the front end of an interface card.

FIG. 1 is a common connector in the prior art. As can be seen, a receiving end 12 includes a pair of contactors 14 for connecting thereto a plugging end 13 disposed at the front end of a corresponding connector 11. The plugging end 13 is for transmitting data from the source end to the destination end of the object machine, and the pair of contactors 14 disposed in the object machine serves as a receiver for contacting the plugging end 13 in order to receive and transfer the data information into the object machine.

The resiliently contacting connection between the corresponding connector 11 and the receiving end 12 is operated by inserting the plugging end 13 e.g. golden fingers into the cavity of the pair of contactors 14, e.g. silver pins, for connecting thereto a corresponding connector. After the connection is performed several times, the connection between the receiving end 12 and the plugging end 13 will be no more sound and become loose caused by the elastic fatigue. On the other hand, the connector in the prior art doesn't have the function of dust-proof to be contaminated in the air, which results in easily a poor connection between the plugging end 13 and the receiving end 12. Furthermore, as plug-in/pull-out is operated in the connector cavity, surfaces of noble metal on the plugging end 13 and the pair of connectors 12 disposed in the receiving end 14 will be scuffed to be worn so that they must be thickened with the noble metal by electroplating, which will increase the total cost for producing the product.

Therefore, it is attempted by the applicant to provide an electrical connector which can rectify the poor match problem when a corresponding connector is connected with a receiving end in the object machine.

SUMMARY OF THE INVENTION

It is therefore an object of the present invention to provide an electrical connector for tightly contacting the corresponding connector for ensuring a sound match therebetween.

It is therefore another object of the present invention to provide a dust-proof electrical connector to protect the electrical connector from being bedaubed and increase the lifetime of the connector.

According to the present invention, there is provided an electrical connector adapted to be used to electrically connect with a first contact terminal. The electrical connector comprises an outer sleeve which has a second terminal and a receptacle, and an inner sleeve which is movably disposed in the receptacle of the outer sleeve for forcing and contacting a second contact terminal to contact with the first contact terminal when the inner sleeve is moved to a specific position relative to the outer sleeve.

Preferably, the first contact terminal is a printed circuit board with plurality of laminated conductors being electrically insulated with each other. The outer sleeve is mounted on a system casing.

Preferably, the second contact terminal further comprises a plurality of pairing resilient conductive pieces which are separated with a space. Each of the conductive resilient pieces has one end for connecting to a system casing and the other free end for piercing through the inner sleeve.

Preferably, each of the conductive resilient pieces has at least two resilient conductors which are separated with a dielectric material.

Preferably, each of the resilient conductors in the present invention has a hook position which is formed at the free end thereof.

Preferably, the inner sleeve in the present invention is made of a resilient and heating-resistant material, which further comprises a first element and two second elements. The first element has a bottom which is accompanied with two opposite faces to define a receiving cavity. The two second elements are pivotally connected to two opposite faces of the first element.

Preferably, each of two second elements has a protrusion which is disposed in an inner surface thereof for forcing a corresponding resilient conductive pieces to contact with the first contact terminal.

According to the present invention, each of the second elements has a cover plate vertically connect to one free end thereof for preventing the dust from entering the electrical connector. The protrusions in the second element of the inner sleeve bias against the resilient conductive pieces when the inner sleeve is moved to the specific position relative to the outer sleeve, thereby forcing the resilient conductive pieces to tightly contact with the first contact terminal at the hook portions thereof.

Preferably, the specific position is located at the bottom of the receptacle in the outer sleeve.

According to another aspect of the present invention, there is provided an electric connector assembly for use to electrically connect a first contact terminal with a system which comprises an outer sleeve further having a receptacle, an inner sleeve for receiving said first contact terminal, and a second contact terminal which has one end for connecting to the system and the other end slidably pierced through the outer sleeve and inner sleeve which is movably disposed in the receptacle of the outer sleeve for forcing the second contact terminal to contact with the first contact terminal when the inner sleeve is moved to a specific position relative to the outer sleeve.

Preferably, the inner sleeve further comprises a first elements and two second elements pivotally connected to the two opposite edges of the first element. Each of the second elements has a protrusion which is disposed in an inner surface thereof for forcing a corresponding resilient conductive pieces to contact with the first contact terminal.

Preferably, the first element has a base for contacting the first contact terminal.

According to further an aspect of the present invention, there is provided an electric connector assembly for use to electrically connect a first contact terminal with a system that the first contact terminal has laminated conductors being electrically Insulated with each other, which comprises an outer sleeve having a receptacle, an inner sleeve which has a base for receiving the first contact terminal, and a second contact terminal which has one end connected to a system casing and the other end is pierced through the outer sleeve and the inner sleeve, wherein the second contact terminal has a plurality of conductors separated with a dielectric material, and the inner sleeve according to the present invention is movably disposed in the receptacle of the outer sleeve for forcing the second contact terminal to contact with the first contact terminal when the inner sleeve is moved to a specific position relative to the outer sleeve.

A better understanding of the present invention can be obtained when the following detailed description of a preferred embodiment is considered in conjunction with the following drawings, in which:

DETAILED DESCRIPTION OF THE PREFFERED EMBODIMENTS

Figure 1:
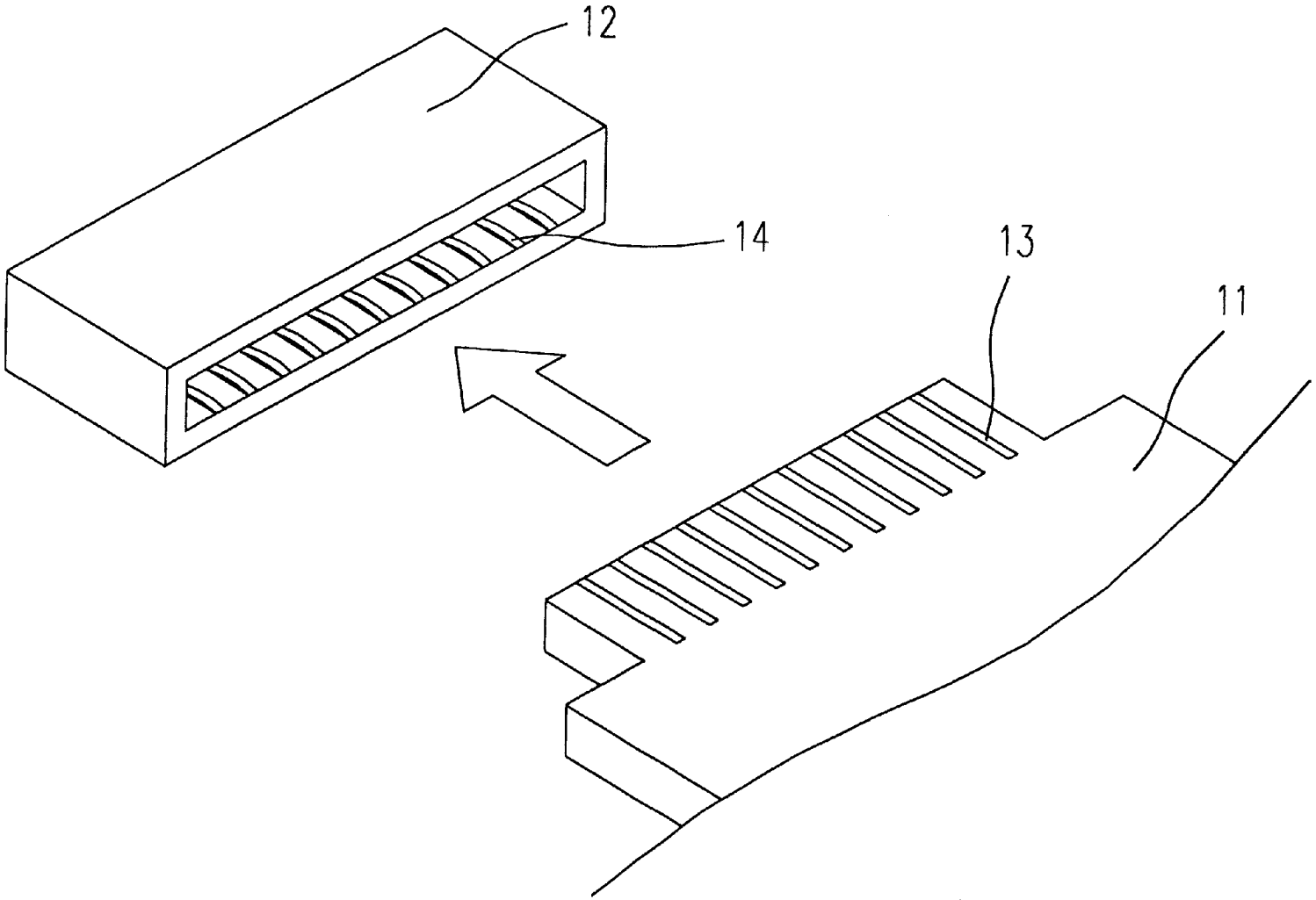
Fig. 1 (Prior Art)
FIG. 1 is a schematic connection of a connector in the prior art.
Figure 2:
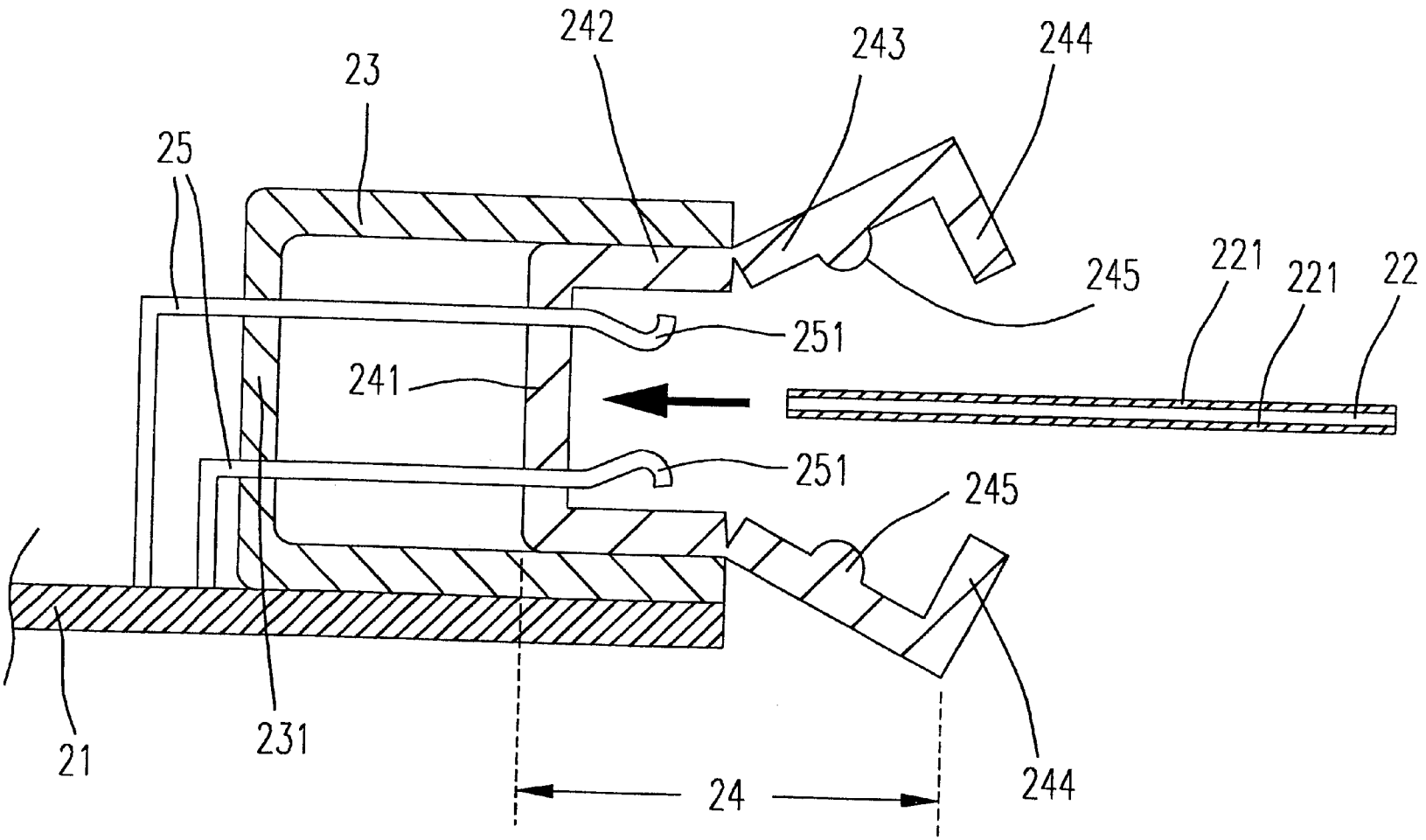
FIG. 2 is a preferred schematic representation of the electrical connector and its components according to the present invention.

FIG. 2 is a preferred schematic representation of the electrical connector and its components according to the present invention. As shown in FIG. 2, the electrical connector in the present invention comprises a printed circuit board 22 as a first contacting terminal including a plurality of laminated contactors 221 being electrically insulated from each other and inserted into the electrical connector in an object machine. The electrical connector in the present invention includes an outer sleeve 23 which has one end mounted on a system casing 21 and a receptacle on the other end for receiving the inner sleeve 24. The inner sleeve 24 is settled in the outer sleeve 23 by a locking pieces which can be a socket, a lock or a cavity disposed between the inner face of the outer sleeve 23 and the outer face of the inner sleeve 24. Alternatively, the inner sleeve can be pulled back and moved into the outer sleeve 25 by an elastic device when the printed circuit board 22 is disconnected from the electrical connector. As can be seen in FIG. 2, a second contact terminal comprises a pair of resilient conductive pieces 25, each of which has one end being connected to a system casing 21 and the other free end pierced into the outer sleeve 23 and the inner sleeve 24, and has a hook portion 251 for contact with the printed circuit board 22 when the electrical connector connects with a corresponding connector. The inner sleeve 24 is made of a resilient and heat-resistant material and disposed in the outer sleeve 23, which can slide into the outer sleeve 23. The inner sleeve 24 further comprises a first element 242 and two second elements 243. The first element 242 has a bottom 241 accompanied with two opposite faces to define a receiving cavity and the two second elements 243 are pivotally connected to two opposite faces of the first element 242. Subsequently, each of two second elements 243 has two components, one of which is a protrusion 245 disposed in the second element 243 for forcing one of the resilient conductive pieces 25 to contact with the first contact terminal 22, and the other is a cover plate 244 vertically connected to one free end of the second element 243 for preventing the dust from entering said electrical connector.

Figure 3:
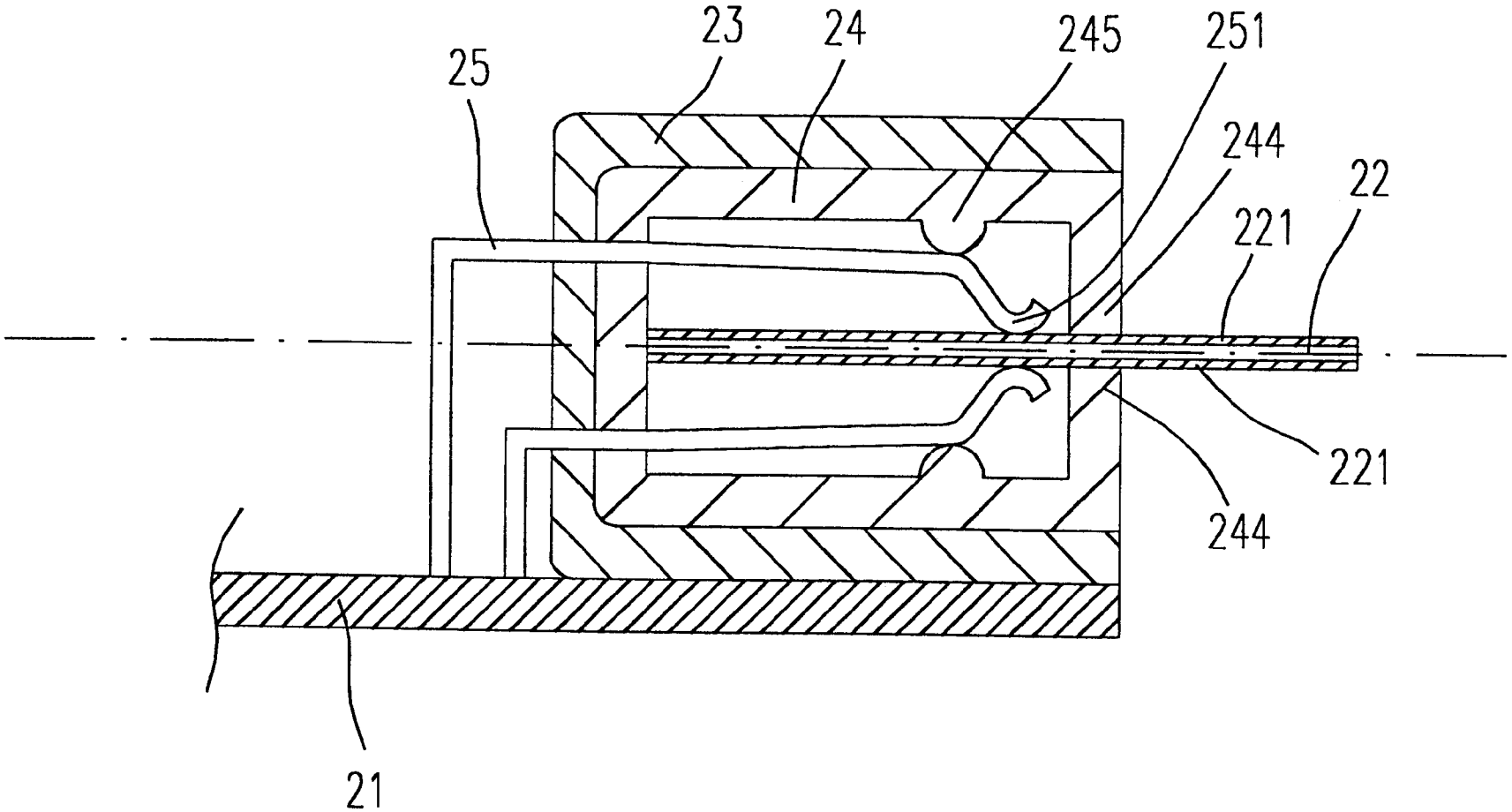
FIG. 3 is a schematic view showing the connection and the relative position of a preferred embodiment of an electrical connector in FIG. 2 according to the present invention.

All the components in FIG. 3 are as those of the FIG. 2 described. FIG. 3, schematically showing the connection and the relative position of an electrical connector is another preferred embodiment in the present invention. As a corresponding connector is connected with the electrical connector, a printed circuit board 22 serves as a first contact terminal which will push the inner sleeve 24 to a specific position at the bottom of the receptacle in the outer sleeve 23. Thereafter the inner sleeve 24 slidably moves and pivots into the bottom of the outer sleeve 23, one of the protrusion 245 in the second element 243 of the inner sleeve 24 will bias against one of relative resilient conductive pieces 25 to contact the printed circuit board 22. At the same time, the pair of cover plates 244 vertically contacts the printed circuit board 22 as a closing guard for preventing the dust from entering the electrical connector.

Figure 4:
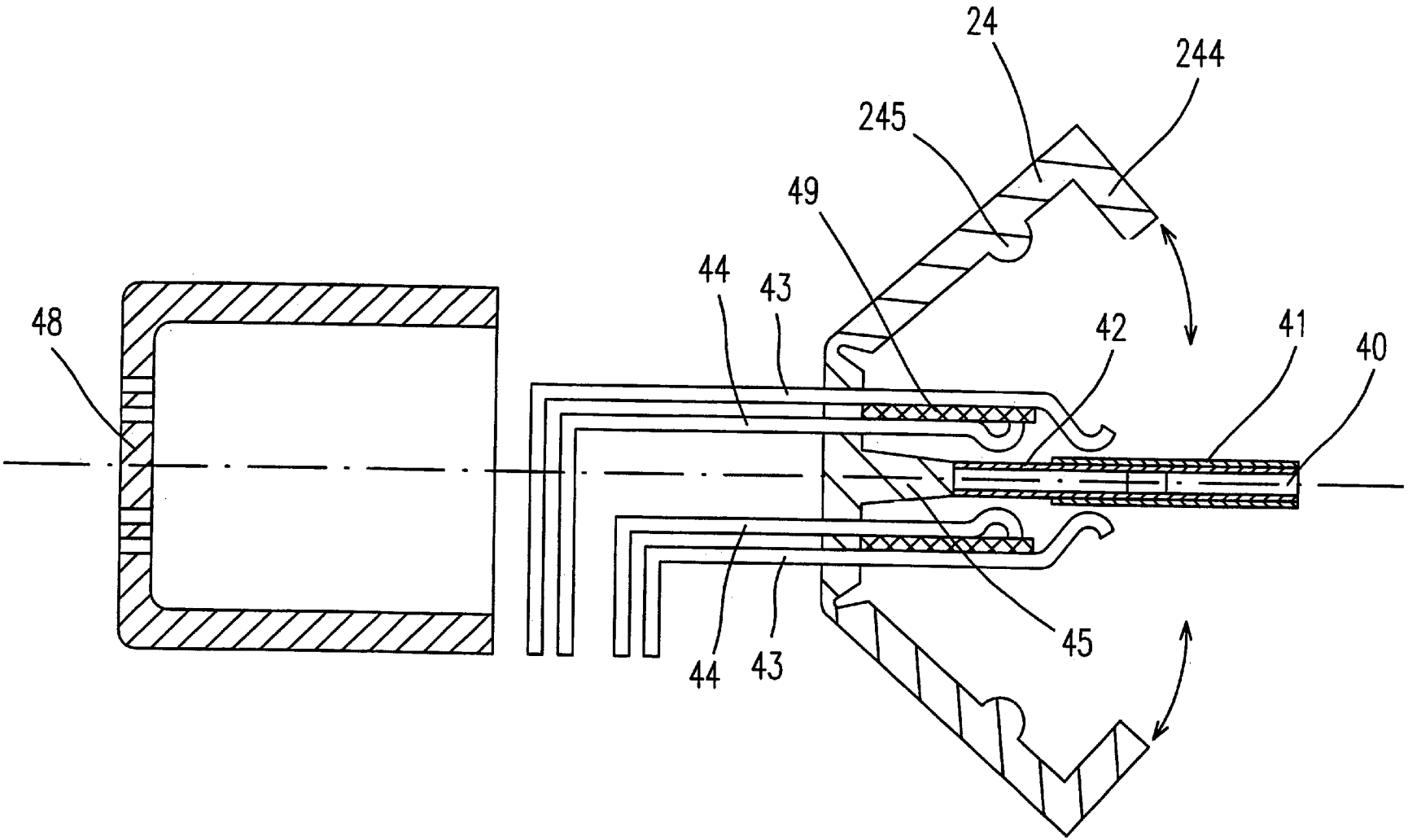
FIG. 4 is another preferred schematic representation of an electrical connector and its components according to the present invention.
Figure 5:
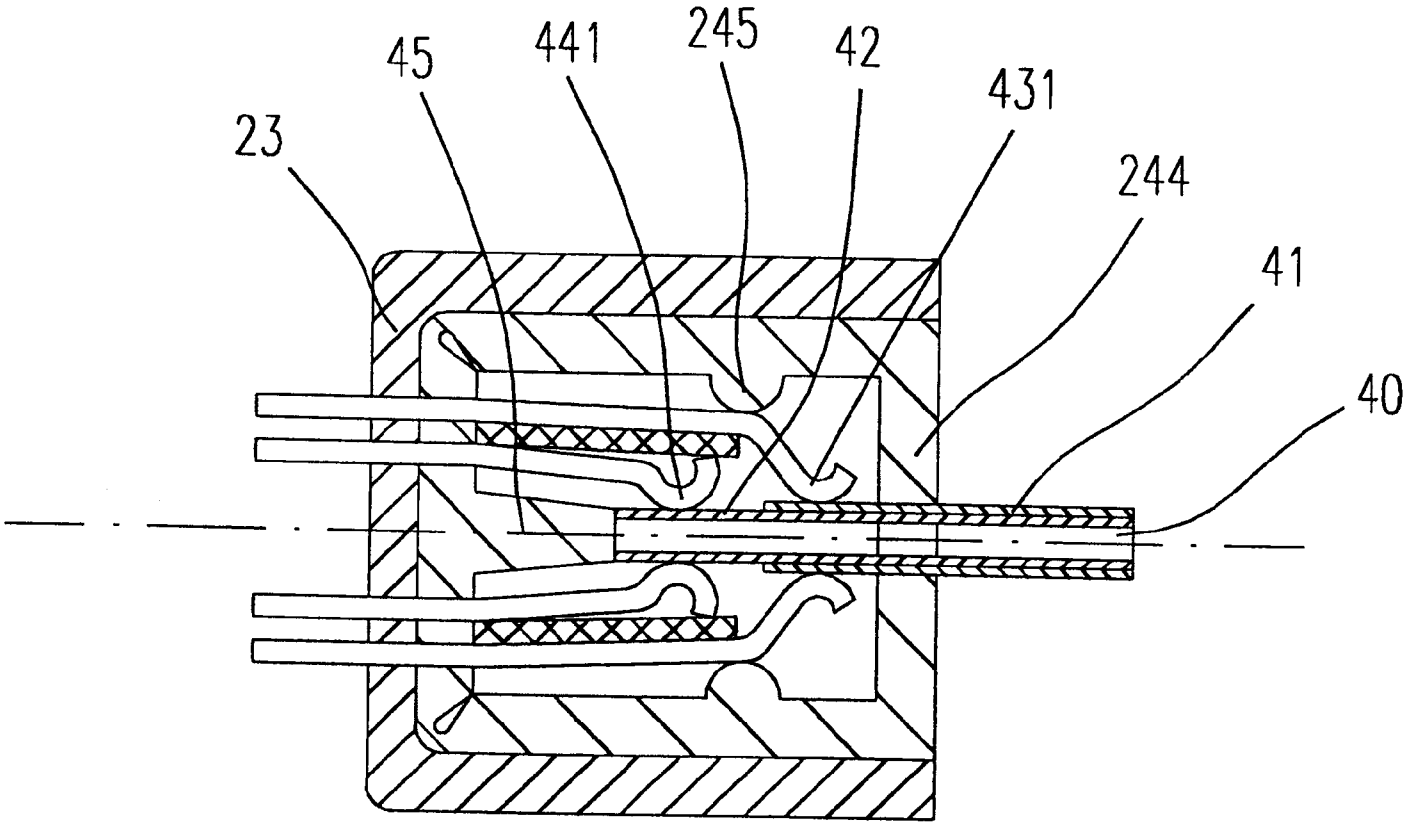
FIG. 5 is a schematic view showing the connecting relationship of the position and the situation of another preferred embodiment of an electrical connector in FIG. 4 according to the present invention.

FIG. 4 and FIG. 5 schematically show the connection between the first contact terminal and an electrical connector. In FIG. 4, the first contact terminal is a multiple printed circuit board 40 with a plurality of laminated conductors 41 and 42 being electrically insulated from each other. The second contact terminal has a plurality of resilient conductive pieces 43 and 44 separated with a space. Furthermore, the plurality of resilient conductive pieces 43 and 44 on the same side are at least two resilient conductors 43, 44 separated with a dielectric material 49. The present invention in FIG. 4 includes a base 45 for contacting the first contact terminal 40 to identify the connecting position at the right place and make sure that the connection between the electrical connector and the corresponding connector is stable.

The connection in FIG. 5 is the same as the FIG. 3 described. When a printed circuit board 40 is inserted into the inner sleeve of the electrical connector, the printed circuit board 40 will reach the base 45 and push the inner sleeve into the outer sleeve 23. After the inner sleeve slidably moves and pivots into the bottom of the outer sleeve 23, the protrusion 245 in the inner sleeve will bias against one of resilient conductive pieces to press the hook portions 431 and 441 to contact the relative portions of the printed circuit board 40. At the same time, the pair of cover plate 244 vertically contacts the printed circuit board 40 as a closing guard for preventing the dust from entering the electrical connector.

The preferred embodiment shown in FIG. 4 and FIG. 5 can be applied to connect with a multiple printed circuit board. Traditionally, the user must reduce the electric induction value for connecting a high electric current by increasing the diameter of the wire or prolonging the length of the printed circuit board, either of which, however, often wastes cost and labor to achieve. The electrical connector in the present invention has the improvement and advantage for reducing the electric induction value.

Figure 6:
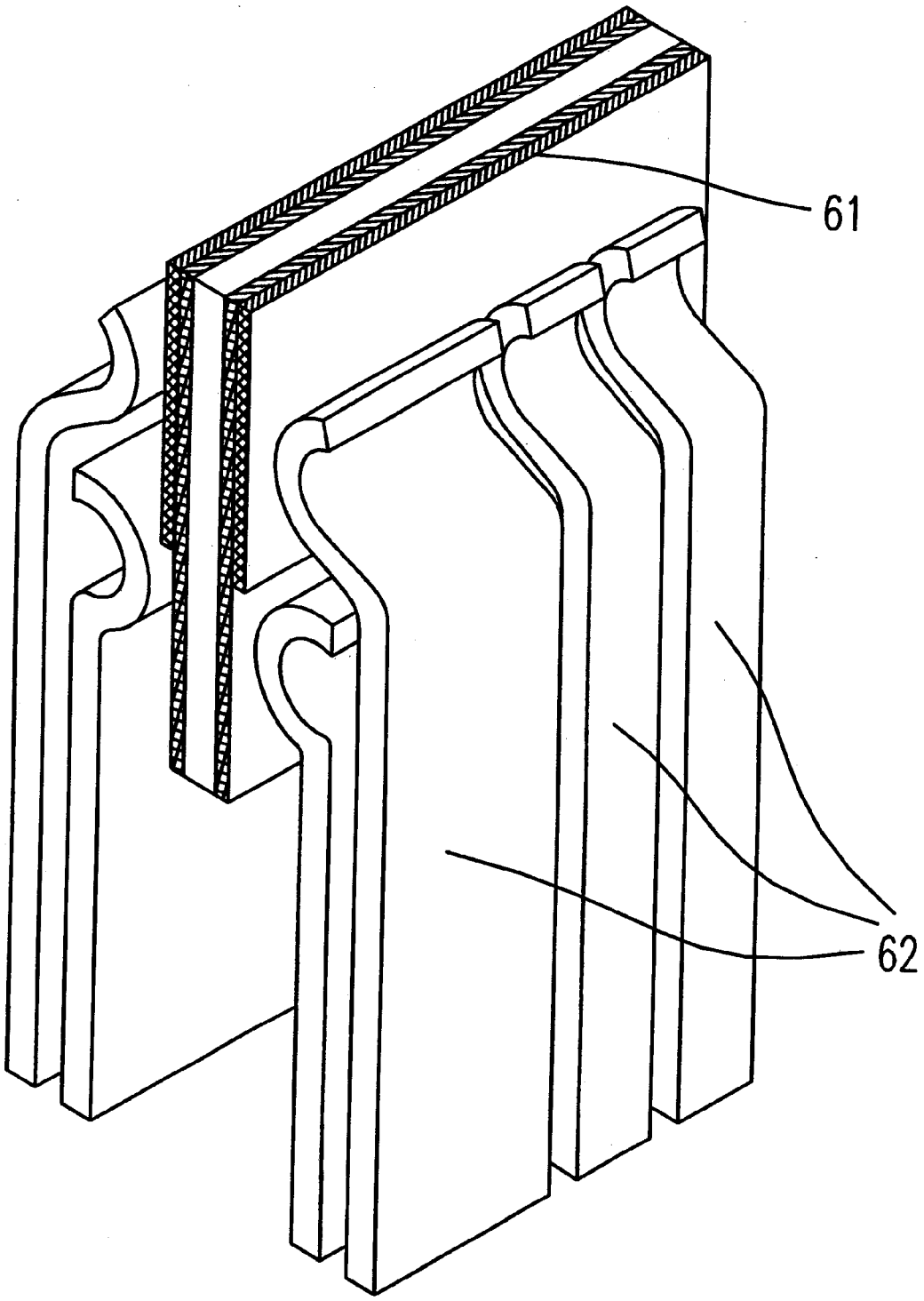
FIG. 6 is a preferred schematic representation for connecting a plurality of laminated conductors of a first contact terminal with a plurality of resilient conductive pieces of a second contact terminal in an electrical connector according to the present invention.

Furthermore, the electrical connector shown in the FIG. 6 includes several sets of pluralities of resilient conductive pieces 62 as the second contact terminal to be connected with a printed circuit board. As can be seen in FIG. 6, a plurality of laminated conductors 61 which serve as a first contact terminal are connected with the pluralities of resilient conductive pieces 62 which serve as a second contact terminal, which assembly is another preferred representation of electrical connector for the present invention.

While the invention has been described in terms of what are presently considered to be the most practical and preferred embodiments, it is to be understood that the invention needs not be limited to the disclose embodiments. On the contrary, it is tented to cover various modification and similar arrangements included within the spirit and scope of the appended claims which are be accorded with the broadest interpretation so as to encompass all such modifications and similar structure.

What we claim is:

1. An electrical connector adapted to be used to electrically connect with a first contact terminal, comprising:

an outer sleeve having a second terminal and a receptacle; and an inner sleeve movably disposed in said receptacle of said outer sleeve for forcing and contacting said second contact terminal to contact with said first contact terminal when said inner sleeve is moved to a specific position within said receptacle, wherein said inner sleeve comprises:

a first element having a bottom accompanied with two opposite faces to define a receiving cavity; and two second elements pivotally connected to said two opposite faces of said first element, wherein each of said second elements has a protrusion disposed in an inner surface thereof for forcing a corresponding resilient conductive piece to contact with said first contact terminal and a cover plate vertically connected to one free end thereof.

2. The electric connector according to claim 1, wherein said first contact terminal is a printed circuit board with a plurality of laminated conductors being electrically insulated from each other.

3. The electrical connector according to claim 1, wherein said outer sleeve is mounted on a system casing.

4. The electric connector according to claim 1, wherein said second contact terminal is a plurality of resilient conductive pieces separated with a space.

5. The electric connector according to claim 4, wherein each of said resilient conductive pieces has one end connected to said system casing and the other free end pierced through said inner sleeve.

6. The electric connector according to claim 5, wherein each of said conductive resilient pieces has at least two resilient conductors separated with a dielectric material.

7. The electric connector according to claim 4, wherein each of said resilient conductors has a hook position formed at said free end thereof.

8. The electrical connector according to claim 1, wherein said inner sleeve is made of a resilient material.

9. The electrical connector according to claim 1, wherein said inner sleeve is made of a heat-resistant material.

10. The electrical connector according to claim 1, wherein said protrusions in said second element bias against said resilient conductive pieces when said inner sleeve is moved to said specific position within said receptacle, thereby forcing said resilient conductive pieces to tightly contact with said first contact terminal at said hook portions thereof.

11. The electrical connector according to claim 10, wherein said specific position is located at the bottom of said receptacle.

12. An electric connector assembly for use to electrically connect a first contact terminal with a system, comprising:

an outer sleeve having a receptacle;

an inner sleeve for receiving said first contact terminal; and a second contact terminal having one end connected to said system and the other end slidably pierced through said outer sleeve and inner sleeve, wherein said inner sleeve is movably disposed in said receptacle of said outer sleeve for forcing said second contact terminal to contact with said first contact terminal when said inner sleeve is moved to a specific position relative said outer sleeve wherein the inner sleeve is moved towards a closed end of the outer sleeve to force said contacts into engagement.

13. The electrical connector according to claim 12, wherein said inner sleeve further comprises:

a first element; and two second elements pivotally connected to said two opposite edges of said first element, wherein each of said second elements has a protrusion disposed in an inner surface thereof for forcing a corresponding resilient conductive piece to contact with said first contact terminal.

14. The electrical connector according to claim 13, wherein said first element has a base for contacting said first contact terminal.

15. An electric connector assembly for use to electrically connect a first contact terminal with a system, wherein said first contact terminal has laminated conductors being electrically insulated with each other comprising:

an outer sleeve having a receptacle;

an inner sleeve having a base for contacting said first contact terminal; and a second contact terminal having one end connected to said system and the other end pierced through said outer sleeve and inner sleeve, wherein said second contact terminal has a plurality of conductors separated with a dielectric material, wherein said inner sleeve is movably disposed in said receptacle of said outer sleeve for forcing said second contact terminal to contact with said first contact terminal when said inner sleeve is moved to a specific position relative to said outer sleeve.

* * * * *